US010343126B2

(12) United States Patent
Toh

(10) Patent No.: US 10,343,126 B2
(45) Date of Patent: Jul. 9, 2019

(54) APPARATUS AND METHOD FOR MIXING AND DISPENSING FLUIDS

(71) Applicant: Colgate-Palmolive Company, New York, NY (US)

(72) Inventor: Kiat-Cheong Toh, Forest Hills, NY (US)

(73) Assignee: Colgate-Palmolive Company, New York, NY (US)

( * ) Notice: Subject to any disclaimer, the term of this patent is extended or adjusted under 35 U.S.C. 154(b) by 780 days.

(21) Appl. No.: 14/667,918

(22) Filed: Mar. 25, 2015

(65) Prior Publication Data

US 2016/0279586 A1 Sep. 29, 2016

(51) Int. Cl.

| | |
|---|---|
| ***B01F 7/00*** | (2006.01) |
| ***B01F 7/16*** | (2006.01) |
| ***B01F 15/02*** | (2006.01) |
| ***B01F 3/12*** | (2006.01) |
| ***B01F 7/18*** | (2006.01) |
| ***B01F 13/00*** | (2006.01) |
| ***B01F 15/00*** | (2006.01) |
| ***B01F 15/04*** | (2006.01) |

(52) U.S. Cl.

CPC ..... *B01F 7/169* (2013.01); *B01F 3/12* (2013.01); *B01F 7/18* (2013.01); *B01F 13/002* (2013.01); *B01F 15/00506* (2013.01); *B01F 15/0215* (2013.01); *B01F 15/0272* (2013.01); *B01F 15/0278* (2013.01); *B01F 15/0491* (2013.01)

(58) Field of Classification Search

CPC ..... B01F 7/169; B01F 15/00506; B01F 3/12; B01F 7/18; B01F 13/002; B01F 15/0215; B01F 15/0272; B01F 15/0278; B01F 15/0491

See application file for complete search history.

(56) References Cited

U.S. PATENT DOCUMENTS

| | | | | |
|---|---|---|---|---|
| 3,290,017 A | | 12/1966 | Davies et al. | |
| 4,556,325 A | * | 12/1985 | Katzin | B01F 7/16 206/219 |
| 5,284,389 A | | 2/1994 | Lumsden | |
| 6,431,402 B1 | | 8/2002 | Klima et al. | |
| 6,854,595 B2 | | 2/2005 | Kiser | |
| 8,881,948 B1 | | 11/2014 | Lassota | |
| 2011/0100999 A1 | | 5/2011 | Clayton | |
| 2013/0240564 A1 | | 9/2013 | Baum | |

FOREIGN PATENT DOCUMENTS

| | | |
|---|---|---|
| EP | 1921016 | 5/2008 |
| WO | WO 02/44031 | 6/2002 |
| WO | WO 2008/1278633 | 10/2008 |
| WO | WO 2010/122552 | 10/2010 |

OTHER PUBLICATIONS

International Search Report and Written Opinion mailed in International Application No. PCT/US2016/023913 dated Jun. 28, 2016.

* cited by examiner

*Primary Examiner* — Anshu Bhatia

(57) ABSTRACT

An apparatus and method for mixing a concentrated product and a liquid. The apparatus includes a body defining an internal volume. A mixing device is positioned at least partially within the internal volume. The mixing device includes one or more vanes that separate the internal volume into a first portion and a second portion when the mixing device is in a first position. The first portion and the second portion are in fluid communication with one another when the mixing device is in a second position.

8 Claims, 9 Drawing Sheets

APPARATUS AND METHOD FOR MIXING AND DISPENSING FLUIDS

BACKGROUND

It is common for a product to be sold in concentrated form to minimize the size and weight of the product. The product may be a liquid or a solid (e.g., a powder) in the concentrated form. Once a user purchases the product, the user may add water to the product to dilute the product. This generally involves first pouring the product into a measuring cup to measure an amount of the product (e.g., ¼ cup). The product is then poured from the measuring cup into a container. Water is then introduced into the measuring cup to measure an amount of the water. The amount of water is dependent upon the desired mixing ratio, which is usually indicated in the instructions on the packaging of the product. If the mixing ratio is 1:4, then 1 cup of water may be measured and poured into the container with the ¼ cup of product. The product and the water may then be mixed in the container (e.g., with a spoon). The mixture may then be used as desired.

BRIEF SUMMARY

An apparatus for mixing a concentrated product and a liquid is disclosed. The apparatus includes a body defining an internal volume. A mixing device is positioned at least partially within the internal volume. The mixing device includes one or more vanes that separate the internal volume into a first portion and a second portion when the mixing device is in a first position. The first portion and the second portion are in fluid communication with one another when the mixing device is in a second position.

A method for mixing a concentrated product and a liquid is also disclosed. The method includes pouring the concentrated product into a first portion of an interior volume of a body and pouring the liquid into a second portion of the interior volume of the body. The first and second portions of the interior volume are separated by one or more vanes of a mixing device when the mixing device is in a first position. The mixing device is moved from the first position to a second position in which the first and second portions of the interior volume are in fluid communication with one another.

In another embodiment, the method includes positioning a mixing device within an interior volume of a body to obtain a predetermined ratio between a first portion of the interior volume and a second portion of the interior volume when the mixing device is in a first position. One or more vanes of the mixing device separate the first and second portions of the interior volume when the mixing device is in the first position. The concentrated product is poured into the first portion of the interior volume. The liquid is poured into the second portion of the interior volume to substantially a same height as the concentrated product. A lid is placed on the body after the concentrated product has been poured into the first portion of the interior volume and the liquid has been poured into the second portion of the interior volume. A shaft of the mixing device extends upward through an opening in the lid after the lid is placed on the body, and the one or more vanes extend radially-outward from the shaft. The shaft is rotated about a central longitudinal axis therethrough to move the mixing device from the first position to a second position in which the first and second portions of the interior volume are in fluid communication with one another.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses. As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
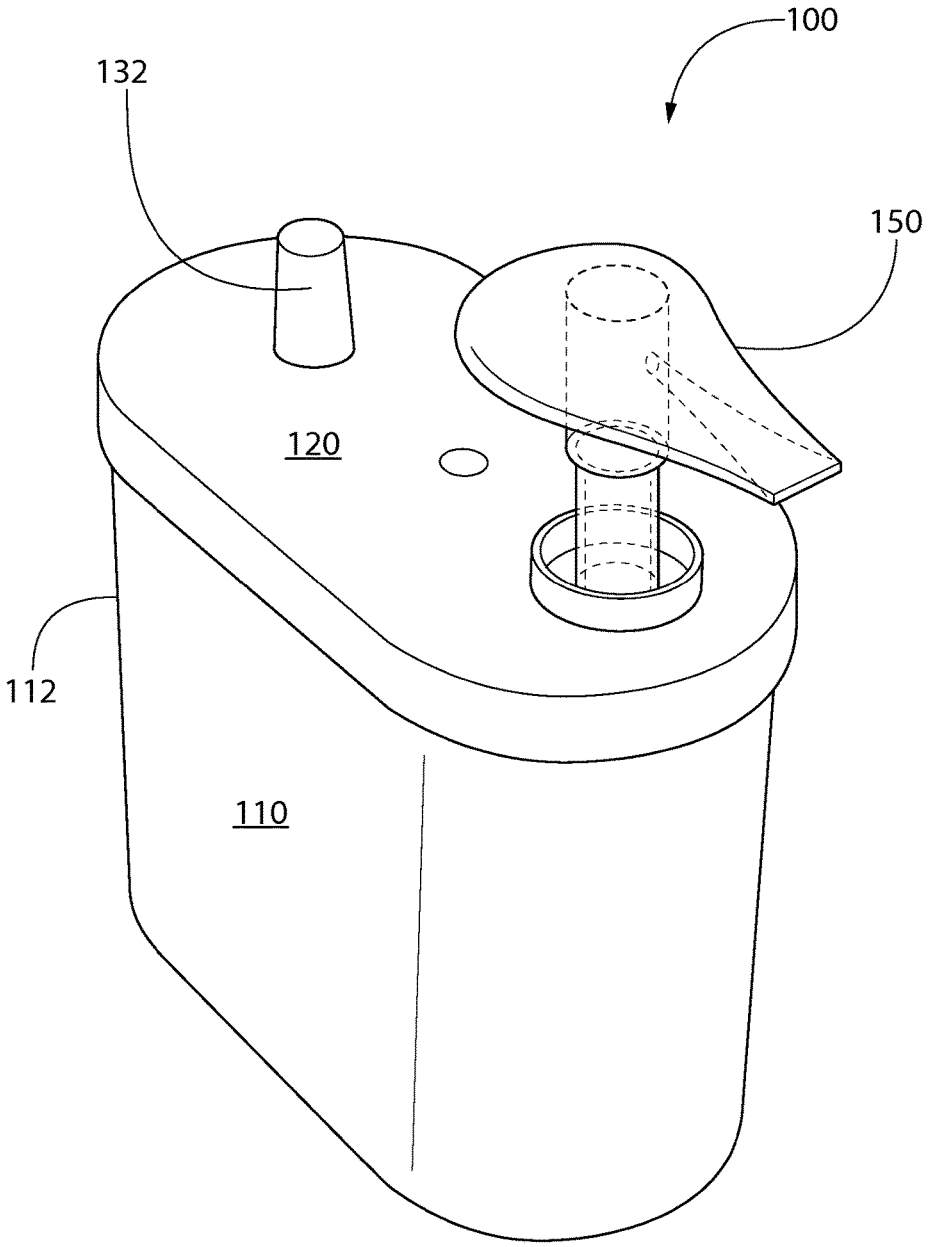
FIG. 1 illustrates an apparatus for mixing and dispensing a concentrated product and a liquid, according to an embodiment.

FIG. 1 illustrates an apparatus 100 for mixing and dispensing a concentrated product and a liquid, according to an embodiment. The apparatus 100 may include a body 110. The body 110 may include a bottom having one or more side walls 112 extending upward therefrom. As shown, a cross-sectional shape of the side wall 112 is an oval. As will be appreciated, in other embodiments, the cross-sectional shape of the side wall(s) 112 may be a circle, a rectangle, a teardrop shape (see FIGS. 7-9), or the like.

A lid 120 may be coupled to an upper surface of the side wall 112. The lid 120 may be coupled to the side wall 112 via a hinge, a threaded engagement, a friction fit, or the like. A handle 132 may extend through an opening in the lid 120. The handle 132 may be used to rotate a mixing device inside the body 110, as described in more detail below. A dispenser 150 may also extend through an opening in the lid 120. The dispenser 150 may be used to dispense a mixture of the concentrated product and the liquid from inside the body 110 to a user, as described in more detail below.

Figure 2:
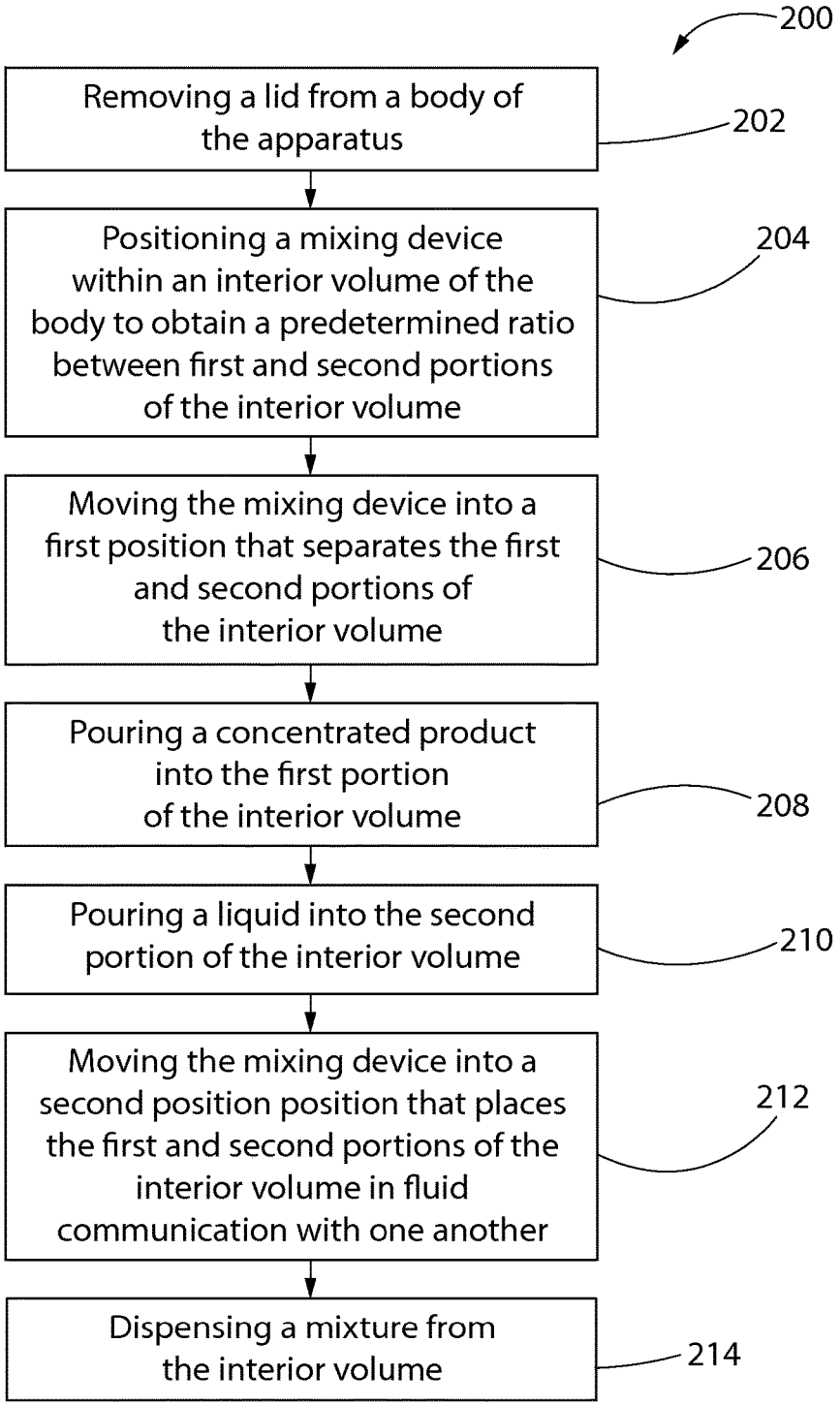
FIG. 2 illustrates a flowchart of a method for mixing the concentrated product and the liquid within the apparatus, according to an embodiment.

FIG. 2 illustrates a flowchart of a method 200 for mixing the concentrated product and the liquid within the apparatus 100, according to an embodiment. The method 200 is illustrated in FIGS. 3-9 and described in the corresponding portion of the description below. The method 200 may begin by removing the lid 120 from the body 110 of the apparatus 100, as at 202.

Figure 3:
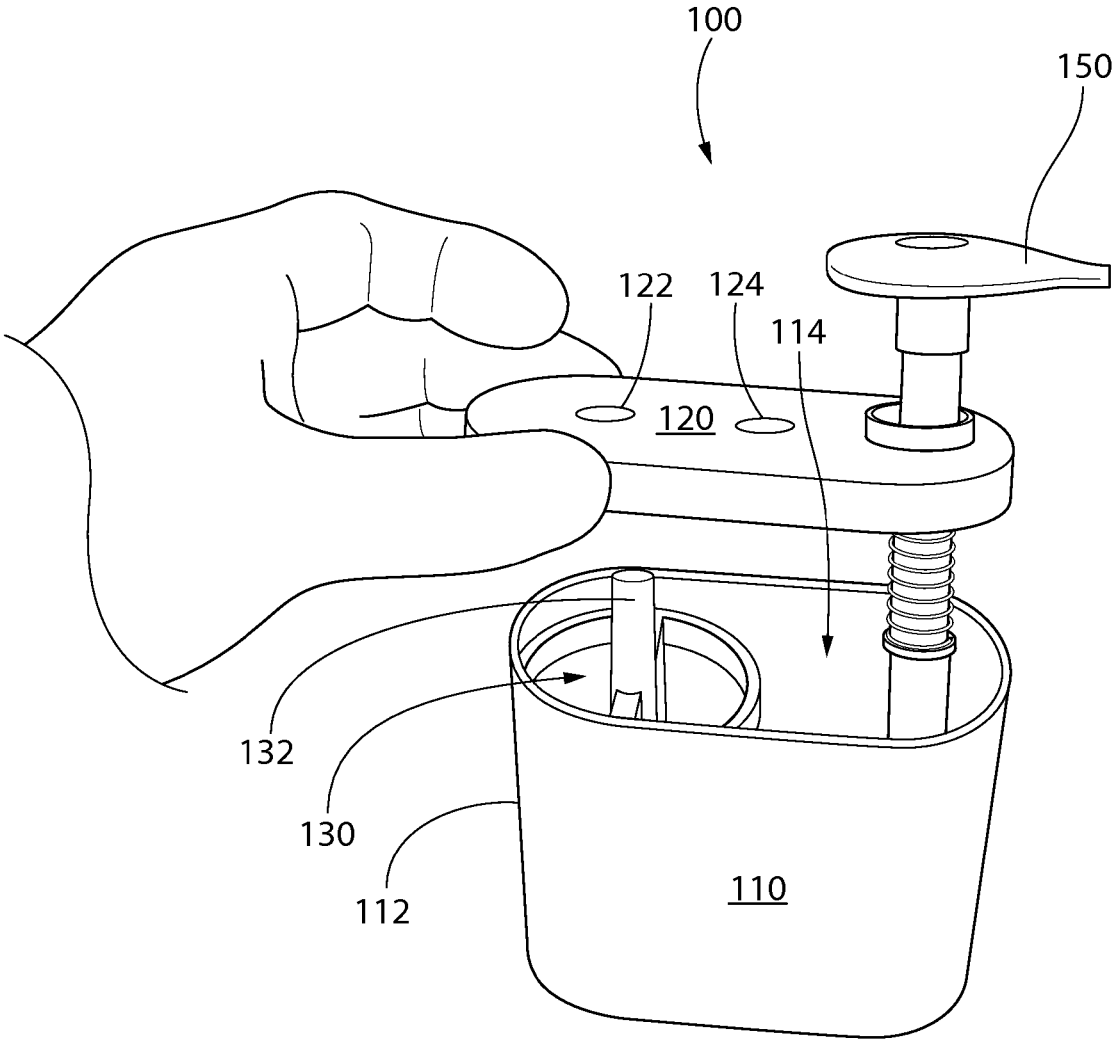
FIG. 3 illustrates a lid of the apparatus being removed from a body of the apparatus, according to an embodiment.

FIG. 3 illustrates the lid 120 being removed from the body 110 of the apparatus 100, according to an embodiment. The body 110 may define an interior volume 114. In at least one embodiment, the dispenser 150 may be coupled to the lid 120 such that the dispenser 150 and the lid 120 may be removed from the body 110 together. As shown, the handle 132 is not coupled to the lid 120. Thus, the handle 132 may remain stationary with respect to the body 110 as the lid 120 is removed. However, in other embodiments, the handle 132 may be coupled to the lid 120.

Figure 4:
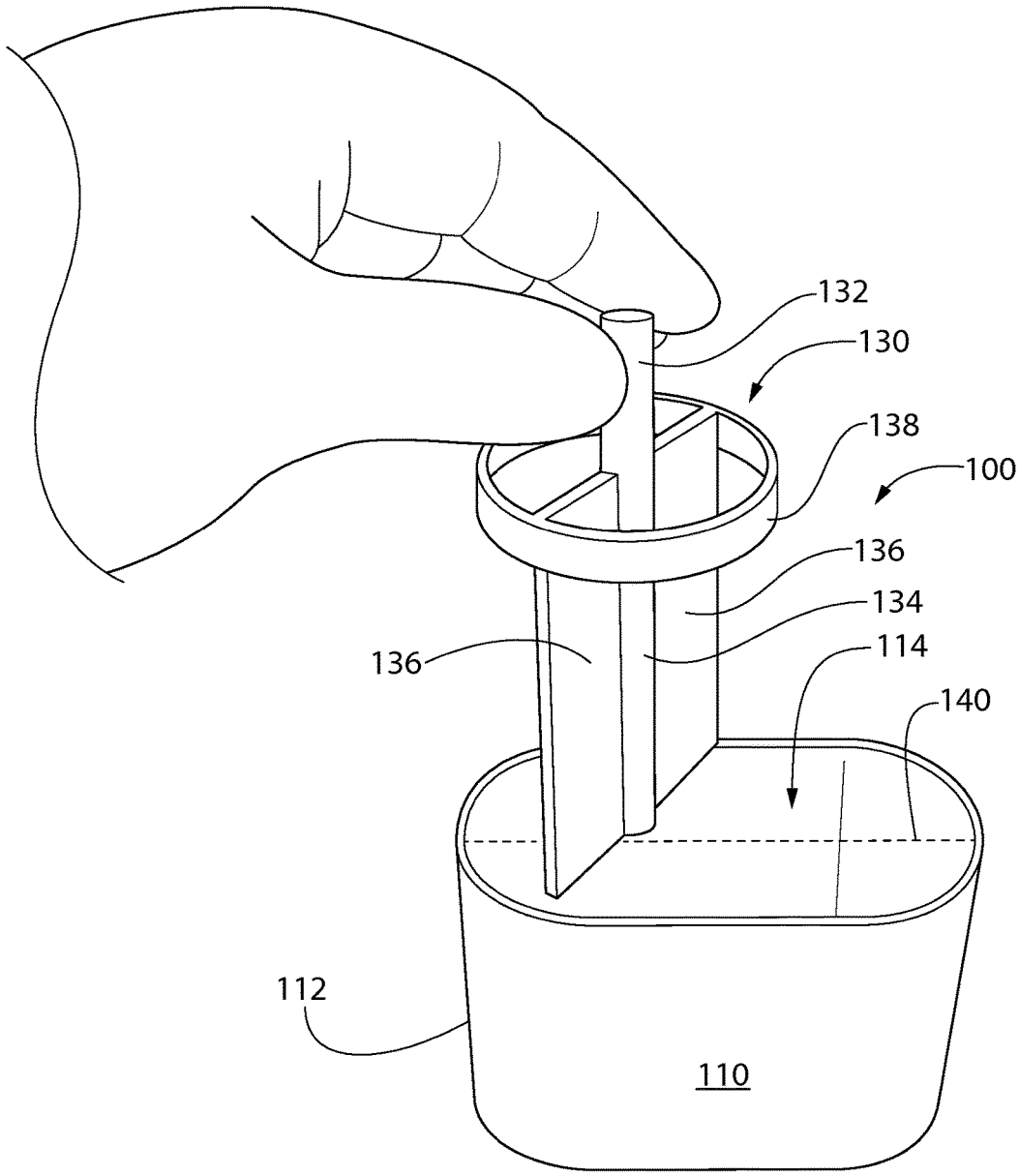
FIG. 4 illustrates a mixing device of the apparatus being positioned in the body of the apparatus, according to an embodiment.

As shown in FIG. 2, the method 200 continues at 204 with positioning a mixing device 130 within an interior volume 114 of the body 110 to obtain a predetermined ratio between a first portion 116 of the interior volume 114 and a second portion 118 of the interior volume 114. Referring now to FIG. 4, this illustration shows the mixing device 130 of the apparatus 100 being positioned in the body 110 of the apparatus 100, according to an embodiment. The mixing device 130 may include the handle 132. A shaft 134 may be coupled to or integral with the handle 132 and extend axially therefrom into the interior volume 114. One or more vanes (two are shown: 136) may be coupled to and extend radially-outward from the shaft 134. The vanes 136 may be circumferentially-offset from one another about the shaft 134. The vanes 136 may be partially or completely molded from a flexible material that may form a seal with the inner surface of the side wall 112 of the body 110 when in contact therewith. For example, the vanes 136 may be made of silicon, elastomer (e.g., thermoplastic elastomer), rubber, or the like.

A guide 138 may be coupled to the outer radial surfaces of the vanes 136. The outer radial surfaces of the vanes 136 may have a notch or slot formed therein, and the guide 138 may be positioned in the notch or slot such that the outer radial surface of the guide 138 is flush with the outer radial surfaces of the vanes 136. In another embodiment, the outer radial surface of the guide 138 may be positioned radially-outward from the outer radial surfaces of the vanes 136. As such, when the mixing device 130 is positioned within the interior volume 114 of the body 110, the guide 138 may be received in a recess in the inner surface of the side wall 112 of the body 110. In some embodiments, the contact between the guide 138 and the inner surface of the side wall 112 of the body 110 may help secure the mixing device 130 in place and prevent the mixing device 130 from wobbling within the interior volume 114.

The mixing device 130 may be positioned within the interior volume 114 of the body 110 to obtain a predetermined ratio between the first portion 116 of the interior volume 114 and the second portion 118 of the interior volume 114. For example, the mixing device 130 may be positioned within the interior volume 114 of the body 110 with the shaft 134 perpendicular to and intersecting a line 140. If the predetermined ratio is 1:1, then the shaft 134 may intersect the midpoint of the line 140. As the predetermined ratio varies, so may the position of the shaft 134 along the line 140, as discussed in more detail below with respect to FIG. 5. The guide 138 may form a friction fit with the inner surface of the body 110 to prevent the mixing device 130 from moving along the line 140.

In some embodiments the apparatus 100 may be designed to provide a single predetermined ratio of the concentrated product 102 to the liquid 104, and the positioning operation 204 of the method 200 may be omitted or modified. Similarly, in such embodiments, the features that allow for multiple positioning of the mixing device 130 may be omitted. For example, one of the two openings 122, 124 may be omitted.

Referring again to FIG. 3, the lid 120 may include one or more openings (two are shown: 122, 124) through which the handle 132 may pass when the lid 120 is placed back onto the body 110. The different positions of the openings 122, 124 may correspond to the different positions of the mixing device 130 in the internal volume 114 to achieve different ratios. For example, the handle 132 of the mixing device 130 may pass through the opening 122 when the mixing device 130 is placed to achieve a 1:4 ratio, and the handle 132 of the mixing device 130 may pass through the opening 124 when the mixing device 130 is placed to achieve a 1:1 ratio. In another embodiment, the openings 122, 124 may be replaced with a single axial slot (not shown) that is parallel to the line 140. In yet another embodiment, the opening 124 may be configured to receive the shaft or handle of a second mixing device having a second set of vanes. The second mixing device may not include a handle and, thus, the opening 124 may be smaller than the opening 122.

The handle 132 or shaft 134 passing through the opening 122 may help to secure the mixing device 130 in place. For example, the contact between the handle 132 or shaft 134 and the portion of the lid 120 defining the opening 122 may serve as an upper bearing. In at least one embodiment, the bottom of the body 110 may include a (e.g., circular) recess configured to receive the lower end of the shaft 134, and the contact between the shaft 134 and the portion of the bottom surface defining the recess may serve as a lower bearing. The upper and lower bearings may secure the mixing device 130 in place while allowing the mixing device 130 to rotate about the shaft 134. The guide 138 may prevent the mixing device 130 from falling over when the lid 120 is removed. The guide 138 may also help align the handle 132 with the opening 122 as the lid 120 is placed back on the body 120.

Figure 5:
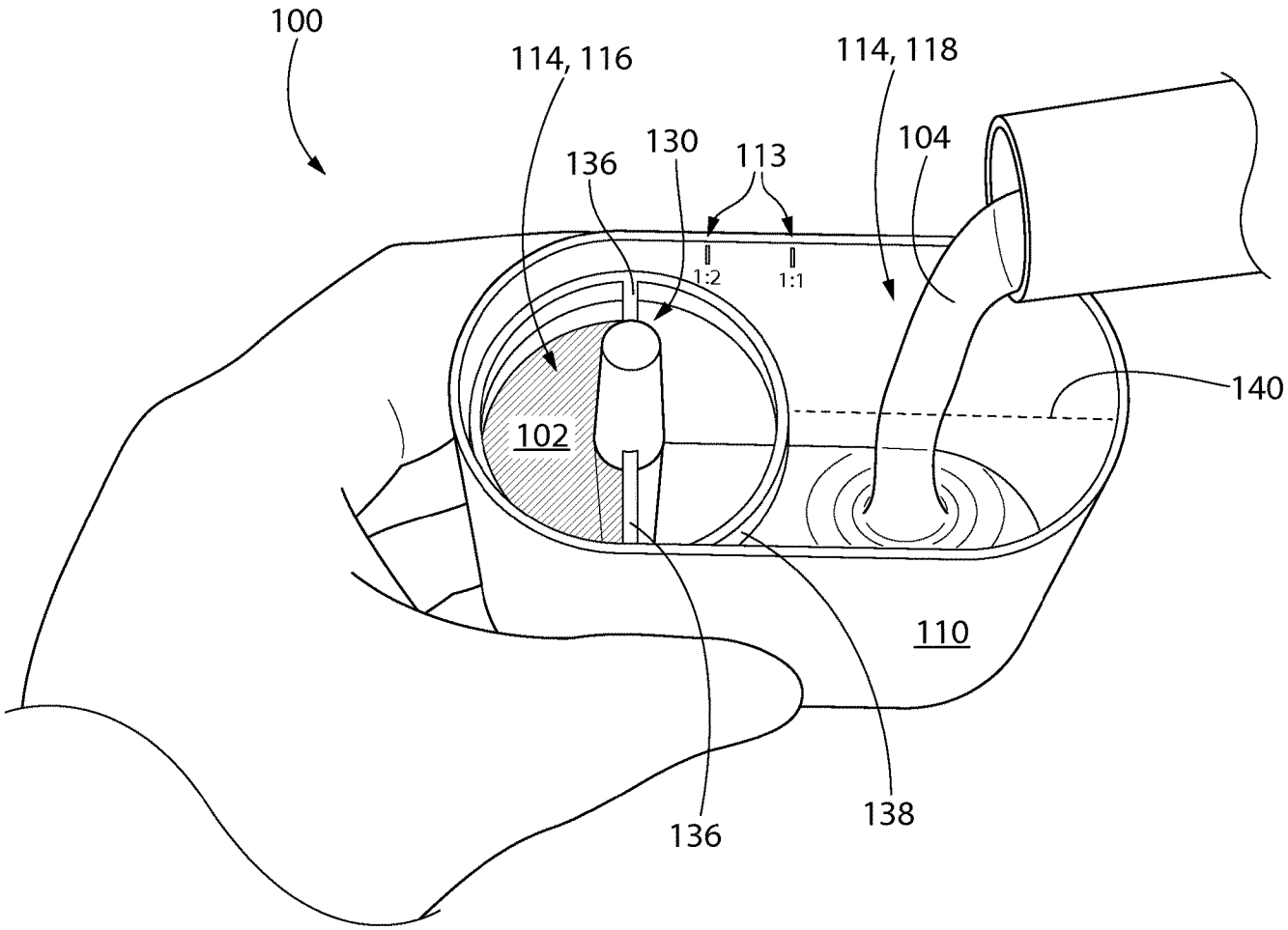
FIG. 5 illustrates the liquid being poured into an interior volume of the body of the apparatus, according to an embodiment.

FIG. 5 illustrates the liquid 104 being poured into the interior volume 114 of the body 110 of the apparatus 100, according to an embodiment. Once the mixing device 130 is positioned in the desired location in the body 110 (e.g., at a point along the line 140 that will produce the desired volume ratio), the mixing device 130 may be moved or placed into a first position (as shown) where the vanes 136 separate the interior volume 114 into the first portion 116 and the second portion 118, as at 206 in FIG. 2. More particularly, the mixing device 130 may be rotated about the handle 132 and shaft 134 so that the outer radial surfaces of one or more of the vanes 136 (e.g., two opposing vanes 136) are in contact with the inner surface of the side wall 112 of the body 110 to form a watertight or nearly watertight seal with the side wall 112 and to separate the interior volume 114 of the body 110 into the first portion 116 and the second portion 118.

As may now be more fully appreciated, the positioning of the mixing device 130 within the body 110 (e.g., along the line 140) may directly affect the ratio of the first portion 116 of the interior volume 114 to the second portion 118 of the interior volume 114. For example, as shown in FIG. 5, the ratio is about 1:3. The ratio may be increased by moving the mixing device 130 to the left along the line 140, and the ratio may be decreased by moving the mixing device to the right along the line 140 (e.g., toward the midpoint of the line 140). Depending upon the positioning of the mixing device 130, the ratio may vary from about 1:1 to about 1:5, about 1:5 to about 1:10, about 1:10 to about 1:20, or more. One or more indicators 113 may be placed on the inner surface or outer surface of the side wall 112 to help place the mixing device 130 in the correct position to achieve the desired ratio.

The concentrated product 102 may be poured into the first portion 116 of the interior volume 114 of the body 110, as at 208 in FIG. 2. The concentrated product 102 may be a solid (e.g., a powder or granules), a liquid, or a gel. Illustrative concentrated products 102 may include soap, detergent, mouthwash, anti-microbial concentrate, drink flavoring, surface cleaner, fabric softener, medication, and the like. The liquid 104 may be poured into the second portion 118 of the interior volume 114 of the body 110, as at 210 in FIG. 2. The liquid 104 may be water, alcohol, a soap or cleaner base, or the like that is suitable to dilute the concentrated product 102. The concentrated product 102 and the liquid 104 may be filled up to the same level (e.g., height, depth, etc.) in the interior volume 114.

Figure 6:
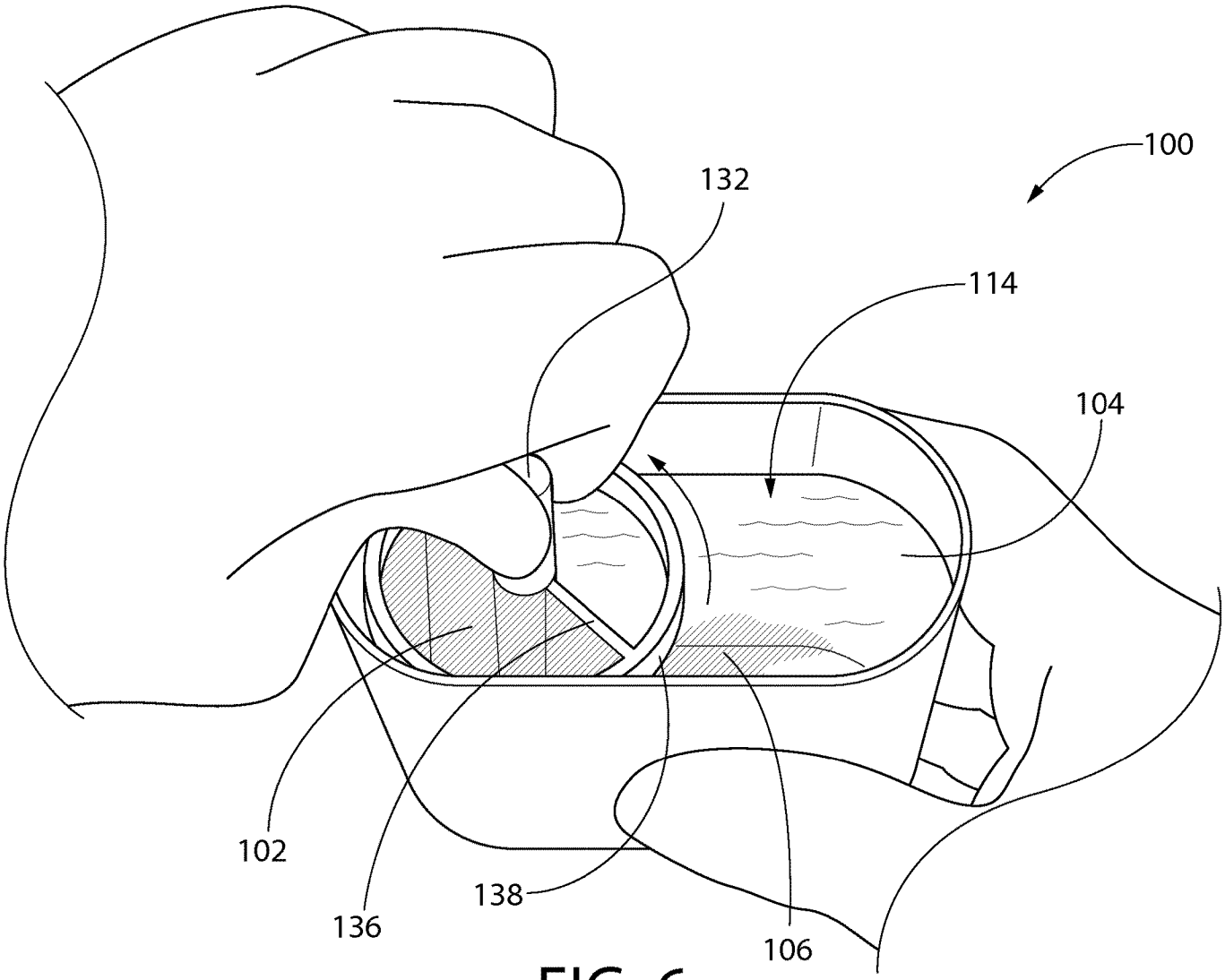
FIG. 6 illustrates the concentrated product and the liquid being mixed together in the internal volume with the mixing device (with the lid removed for clarity), according to an embodiment.

FIG. 6 illustrates the concentrated product 102 and the liquid being mixed together in the interior volume 114 of the body 110 with the mixing device 130 (with the lid 120 removed for clarity), according to an embodiment. The mixing device 130 may be moved (e.g., rotated) into a second position that places the first and second portions 116, 118 of the interior volume 114 in fluid communication with one another, as at 212 in FIG. 2. In the second position, the concentrated product 102 and the liquid 104 may comingle or be mixed together to form a mixture 106 in the interior volume 114 of the body 110. In one embodiment, the handle 132 may be twisted or rotated by hand to cause the mixing device 130 to rotate about the shaft 134 (into and through the second position), thereby causing the concentrated product 102 and the liquid 104 to mix. For example, as the mixing device 130 is rotated 180 degrees or more, the vanes 136 may move in and out of contact with the inner surface of the side wall 112 of the body 110. When the vanes 136 are out of contact with the inner surface of the side wall 112 of the body 110, the first and second portions 116, 118 of the interior volume 114 may be in fluid communication with one another. During this time interval, the rotary motion of the vanes 136 may function as a horizontal windmill to move the concentrated product 102 and the liquid 104 around such that they mix together.

In addition to manually moving the handle 132, in other embodiments, a motor may be coupled to the mixing device 130, and the motor may cause the mixing device 130 to move or rotate. In yet another embodiment, the movement (e.g., pumping or reciprocating) of the dispenser 150 may cause the mixing device 130 to move or rotate.

In at least one embodiment, the mixing device 130 may include one or more additional vanes (not shown). For example, the additional vanes may be static (e.g., stationary) with respect to the vanes 136. In another example, the additional vanes may rotate together with the vanes 136. In yet another example, the additional vanes may rotate in the opposite direction of the vanes 136. The additional vanes may have the same dimensions (e.g., height and radial length) or different (e.g., shorter) dimensions from the vanes 136. The additional vanes may also have slots or holes formed therethrough to customize or control the mixing of the concentrated product 102 and the liquid 104. Such embodiments may be desirable for mixing a solid concentrated product 102 (e.g., a powder or granules) with the liquid 104.

Figure 7:
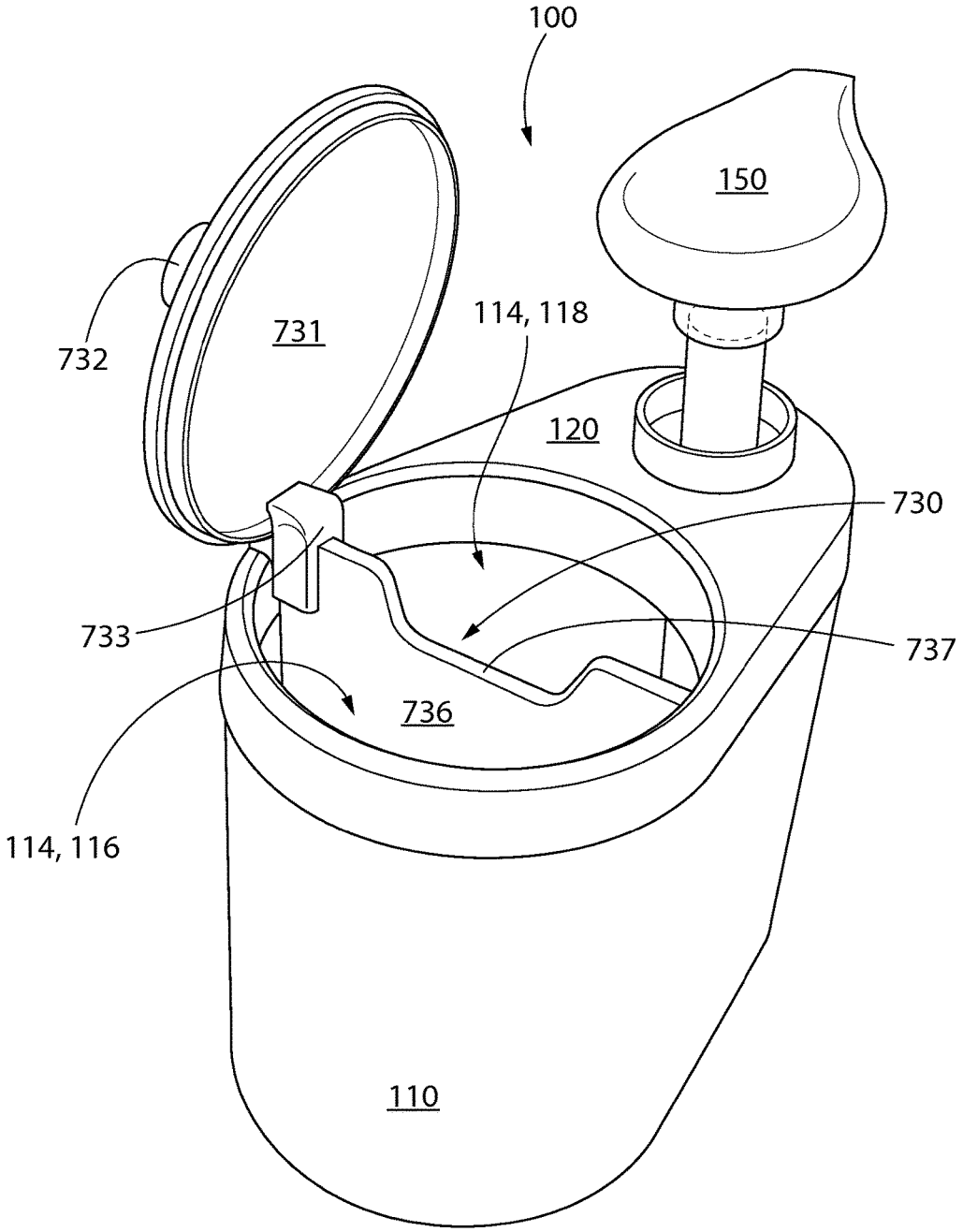
FIG. 7 illustrates another mixing device including a single vane with a notch formed therein, according to an embodiment.
Figure 8:
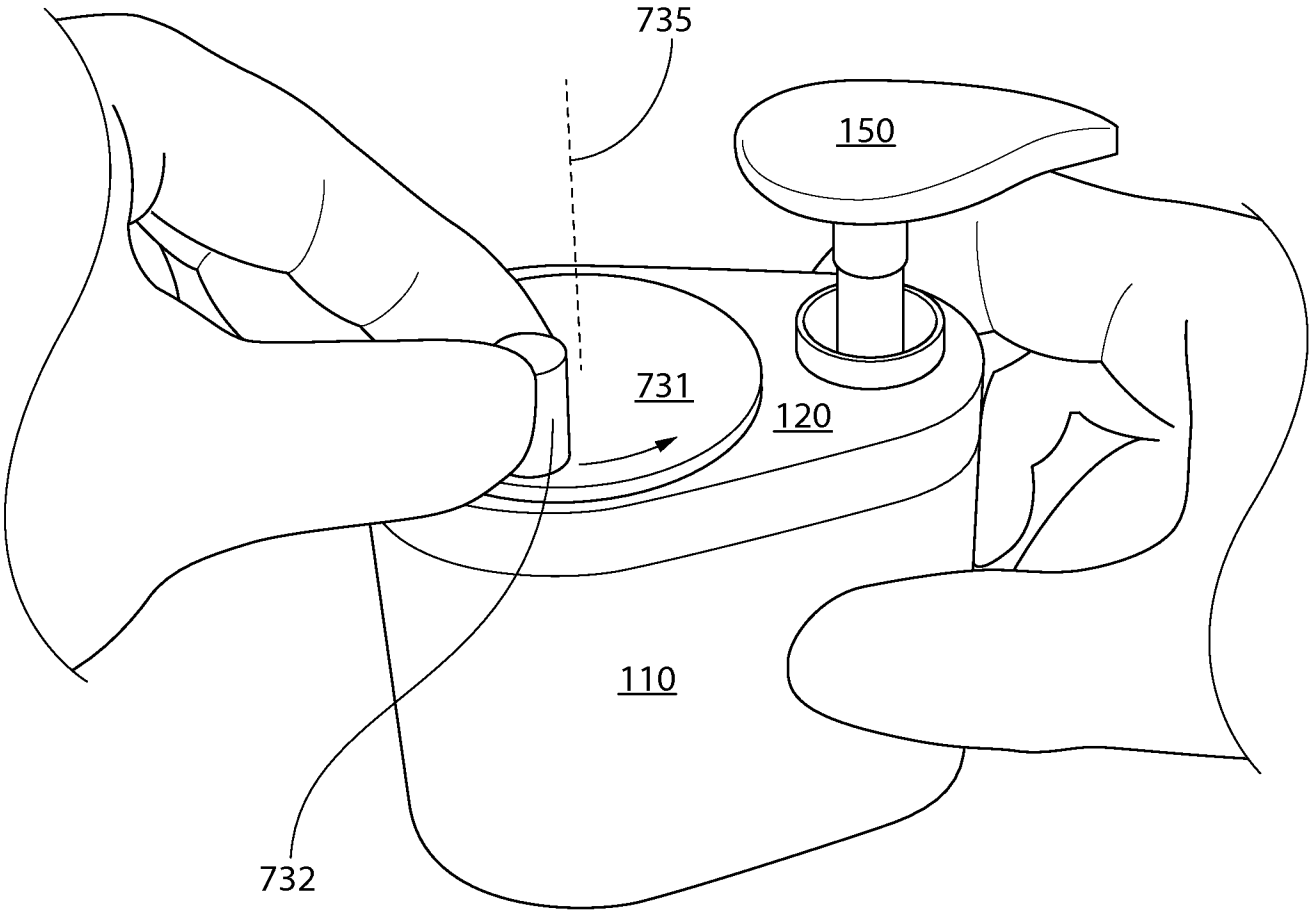
FIG. 8 illustrates the concentrated product and the liquid being mixed together in the internal volume with the mixing device (with the lid coupled to the body), according to an embodiment.

FIG. 7 illustrates another mixing device 730 including a single vane 736 having an indicator 737 (e.g. a notch) formed therein, according to an embodiment. In the embodiment of FIG. 7, the handle 132 and the shaft 134 may be omitted. A single vane 736 may be in contact with opposing inner surfaces of the body 110 when the mixing device 730 is in the first position, as shown. The mixing device 730 may include a cover 731 that is coupled with the vane 736 (e.g., via a hinge 733). The hinge 731 may allow the cover 731 to transition between an open position (as shown in FIG. 7) and a closed position (as shown in FIG. 8). When in the closed position, the cover 731 may be substantially flush with the lid 120. The cover 731 may have a handle 732 coupled to or integral therewith.

In one embodiment, the mixing device 730 may have one or more indicators 737 to help a user to determine when the concentrated product 102 and the liquid 104 are filled up to the same level in the interior volume 114. As shown in FIG. 7, the indicator 737 may be a notch or opening in the vane 736. The indicator 737 may show the maximum suggested fill level of the interior volume 114 so the mixing process does not cause the mixture 106 to overflow over the side wall 112. For example, the user may fill the first portion 116 of the interior volume 114 with the concentrated product 102 until the concentrated product 102 is at the bottom of the indicator 737 or flows slightly over the indicator 737 (e.g., into the second portion 118). The same may be done for the liquid 104 in the second portion 118.

FIG. 8 illustrates the concentrated product 102 and the liquid 104 being mixed together in the body 110 with the mixing device 730 (with the lid 120 coupled to the body 110), according to an embodiment. Once the concentrated product 102 and the liquid 104 are poured into the first and second portions 116, 118 of the interior volume 114, respectively, the cover 731 may be closed. The user may then twist or rotate the handle 732 about a central longitudinal axis 735 through the cover 731. This may cause the vane 736 to rotate within the interior volume 114 of the body 110 (e.g., from the first position to the second position) such that the concentrated product 102 and the liquid 104 may commingle or be mixed together to form the mixture 106. As shown in FIG. 8, the handle 732 may be radially-offset from the central longitudinal axis 735; however, in other embodiments, the handle 732 may be aligned with the central longitudinal axis 735.

Figure 9:
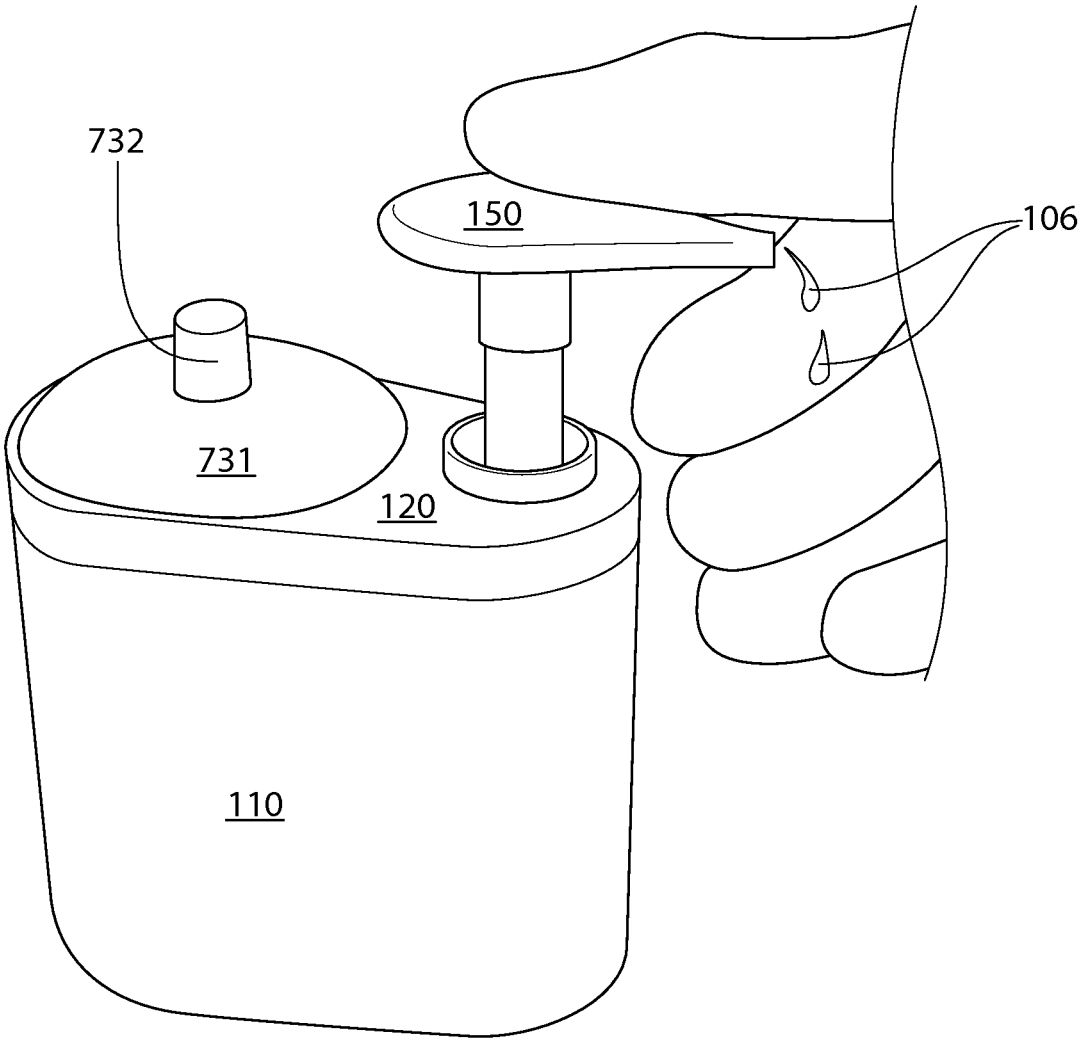
FIG. 9 illustrates the mixture being dispensed from the apparatus, according to an embodiment.

FIG. 9 illustrates the mixture 106 of the concentrated product 102 and the liquid 104 being dispensed from the apparatus 100, according to an embodiment. Once the concentrated product 102 and the liquid 104 have been mixed to form the mixture 106, the mixture 106 may be dispensed from the apparatus 100, as at 214 in FIG. 2. As shown in FIG. 9, the dispenser 150 may be or include a lotion pump that may be pressed downward to cause a portion of the mixture 106 to be dispensed therefrom. In another embodiment, the dispenser 150 may be or include a trigger spray. In yet another embodiment, there may be no dispenser 150 and the mixture 106 may simply be poured from the apparatus 100 into a desired location.

The apparatus 100 may be refilled with the concentrated product 102 and the liquid 104 when the interior volume 114 is empty or when a portion of the mixture 106 still remains within the interior volume 114. For example, the mixing device 130 may be rotated about the handle 132 and shaft 134 so the vanes 136 separate the interior volume 114 into the first portion 116 and the second portion 118 again. The remaining mixture 106 may be at the same height in the first and second portions 116, 118 of the interior volume 114 (e.g., 1 cm deep). Additional concentrated product 102 may be added to the mixture 106 in the first portion 116, and additional liquid 104 may be added to the mixture 106 in the second portion 118 until the heights in the first and second portions 116, 118 are substantially the same (e.g., 5 cm deep). Then, the mixing device 130 may once again be rotated to mix the additional concentrated product and the additional liquid to form the mixture 106 at the same ratio as described above.

What is claimed is:

1. An apparatus for mixing a concentrated product and a liquid, comprising:

a body defining an internal volume; and a mixing device positioned at least partially within the internal volume, wherein the mixing device comprises one or more vanes that separate the internal volume into a first portion and a second portion when the mixing device is in a first position, the mixing device further comprising a guide that at least partially surrounds the one or more vanes, wherein the first portion and the second portion are in fluid communication with one another when the mixing device is in a second position, wherein the one or more vanes define a notch or slot, and wherein the guide is positioned within the notch or slot such that an outer radial surface of the guide is substantially flush with outer radial surfaces of the one or more vanes, and wherein outer radial surfaces of the one or more vanes are in contact with an inner surface of the body to sealingly separate the first and second portions when the mixing device is in the first position.

2. The apparatus of claim 1, wherein the one or more vanes are configured to be rotated about a shaft of the mixing device to move the mixing device from the first position to the second position, and wherein the one or more vanes are positioned radially-outward from the shaft.

3. The apparatus of claim 1, wherein the guide is at least partially received in a recess in an inner surface of the body.

4. The apparatus of claim 2, further comprising a lid that is configured to be coupled to the body, wherein a handle that extends axially from the shaft of the mixing device extends through a first opening in the lid.

5. The apparatus of claim 4, wherein the handle is configured to be rotated by a user to cause the mixing device to move from the first position to the second position.

6. The apparatus of claim 4, further comprising a dispenser that extends through a second opening in the lid.

7. The apparatus of claim 1, further comprising a cover coupled to the one or more vanes, wherein a handle that is coupled to or integral with the cover is configured to be rotated by a user to cause the mixing device to move from the first position to the second position.

8. The apparatus of claim 1, wherein a ratio of the first portion of the internal volume to the second portion of the internal volume varies from about 1:1 to 1:5.

* * * * *